US007509911B2

(12) United States Patent
Muskat et al.

(10) Patent No.: US 7,509,911 B2
(45) **Date of Patent: *Mar. 31, 2009**

(54) DISINTEGRATING HUNTING BULLET

(75) Inventors: Erich Muskat, Roth (DE); Heinz Riess, Furth (DE); Andreas Hadler, Langenzenn (DE); Erich Zeiher, Furth (DE)

(73) Assignee: Ruag Ammotec GmbH, Furth (DE)

( * ) Notice: Subject to any disclaimer, the term of this patent is extended or adjusted under 35 U.S.C. 154(b) by 470 days.

This patent is subject to a terminal disclaimer.

(21) Appl. No.: 10/489,980

(22) PCT Filed: Sep. 18, 2002

(86) PCT No.: PCT/DE02/03523

§ 371 (c)(1),
(2), (4) Date: Oct. 14, 2004

(87) PCT Pub. No.: WO03/027602

PCT Pub. Date: Apr. 3, 2003

(65) Prior Publication Data

US 2005/0066848 A1 Mar. 31, 2005

(30) Foreign Application Priority Data

Sep. 22, 2001 (DE) ..... 101 46 797
Aug. 30, 2002 (DE) ..... 102 39 910

(51) Int. Cl.
*F42B 8/14* (2006.01)

(52) U.S. Cl. ..... 102/516; 102/506

(58) Field of Classification Search ..... 102/506, 102/501, 514, 515, 516, 517
See application file for complete search history.

(56) References Cited

U.S. PATENT DOCUMENTS

| | | | | |
|---|---|---|---|---|
| 4,353,305 | A | 10/1982 | Moreau et al. | |
| 5,454,325 | A | 10/1995 | LeBlanc | |
| 5,963,776 | A * | 10/1999 | Lowden et al. | 419/64 |
| 6,691,623 | B1 * | 2/2004 | Stone | 102/506 |
| 2002/0124759 | A1 | 9/2002 | Amick | |

FOREIGN PATENT DOCUMENTS

| | | |
|---|---|---|
| WO | WO 93 08442 | 4/1993 |

* cited by examiner

*Primary Examiner*—James S Bergin
(74) *Attorney, Agent, or Firm*—Antonelli, Terry, Stout & Kraus, LLP.

(57) ABSTRACT

The disintegration of a bullet in the body of a wild animal is determined by the power output of the bullet and therefore by the effect of the shot. A different type of disintegration is required for small as opposed to large animals. According to the invention, a disintegrating hunting bullet is provided in the form of an enveloped bullet, characterized in that the core (3) is made of balls (4,5) or granules made of a metal substance and the balls (4,5) or granules are pressed free from cavities in order to create set rupture points.

20 Claims, 6 Drawing Sheets

DISINTEGRATING HUNTING BULLET

This application is related to co-pending application number 10/489,979, filed Oct. 12, 2004.

The invention relates to a disintegrating hunting projectile as a jacketed projectile.

The disintegration of a projectile in the body of a game animal after penetration thereinto determines the energy deposition of the projectile and thus the effect of the shot. The disintegration desired in the case of small game is different from that in the case of large game.

The goal of the invention is therefore to find a projectile that, upon penetration into the target medium, disintegrates in a fashion attuned to the game being hunted into a well-defined quantity of splinters with well-defined splinter size.

In order to meet this goal there is proposed a jacketed projectile, which can be both a soft-nosed projectile and a full-jacketed projectile, whose projectile core is made up of balls or granulate of a metallic material compacted in void-free fashion. All materials that can be compacted into a void-free core, including among others lead or lead-containing alloys, are suitable as material for the balls or granulate. For reasons of environmental protection, in order advantageously to avoid contamination of the soil and game, lead-free materials are used by preference.

The compacted projectile core of balls or granulate held by the projectile jacket disintegrates with the projectile jacket upon hitting the target. The diameter of the balls or the grain size of the granulate then determines both the energy deposition and also the predetermined fracture zones in the projectile core and thus the size of the individual parts arising upon its disintegration. Larger balls or granulate particles penetrate more deeply into the target medium and produce in the tissue a more deeply penetrating damage channel than a number of smaller balls or granulate particles comparable in mass. Sharp edges, which increase the effectiveness of the splinters, arise on the compacted balls or granulate particles through compaction of the core material.

The size of the balls or granulate depends on the caliber and lies between 1 mm and 12 mm, preferably between 3 mm and 6 mm. The balls with the largest diameter are used, for example, in the case of caliber .50.

The projectile core can also be composed in such fashion that the forward region, for example the ogival region, is made up of balls or granulate particles smaller in size than the cylindrical part. In this way the core disintegrates into many small splinters as soon as impact takes place. The two regions cannot be compacted jointly. Each region must be compacted individually. The balls or granulate particles varying in size can also be made up of different materials, it being necessary, however, to guarantee the optimal center of gravity position with respect to ballistics.

The balls or granulate particles can be coated before compaction with a release substance in order to guarantee better disintegration in the target. Examples of substances suitable as a release agent are graphite and polytetrafluoroethylene (Teflon).

The projectile cores can also be inserted into the jackets as prefabricated items, that is, precompacted into the projectile shape.

If it is desired that the projectile disintegrate as soon as impact takes place or at a shallow depth of penetration, for example in the case of lower projectile velocities, predetermined fracture zones in the jacket are advantageous. The predetermined fracture zones run in the axial direction and lie on the inside of the jacket, preferably in the ogival region. The disintegration of the projectile can be influenced by the number and the position of the predetermined fracture zones in the jacket. The closer the predetermined fracture zones lie to the tip of the projectile, the sooner the jacket expands and disintegrates into splinters. Further predetermined fracture zones can be radially running notches on the external periphery such as for example a sharp edge in the case of hunting projectiles.

Copper, its alloys, clad steel, soft iron, and zinc-tin alloys are particularly suitable as materials for the jacket.

The structure described for the projectile core is suitable for all projectile types that are capable of partial or complete disintegration. This also includes projectiles with a partly hard core, with a projectile core of different materials, and projectiles with an additional, nondisintegrating penetrator in the projectile nose or in the projectile tail, as are known for example from WO 01/20244 A1 or respectively from WO 01/20245 A1.

As a result of the indicated design possibilities for the core of a projectile, it is possible to fabricate projectiles that are attuned to the intended application in question and that achieve an optimal effect at any impact velocity because of their disintegration behavior attuned thereto.

The invention is explained in greater detail on the basis of exemplary embodiments.

Figure 1:
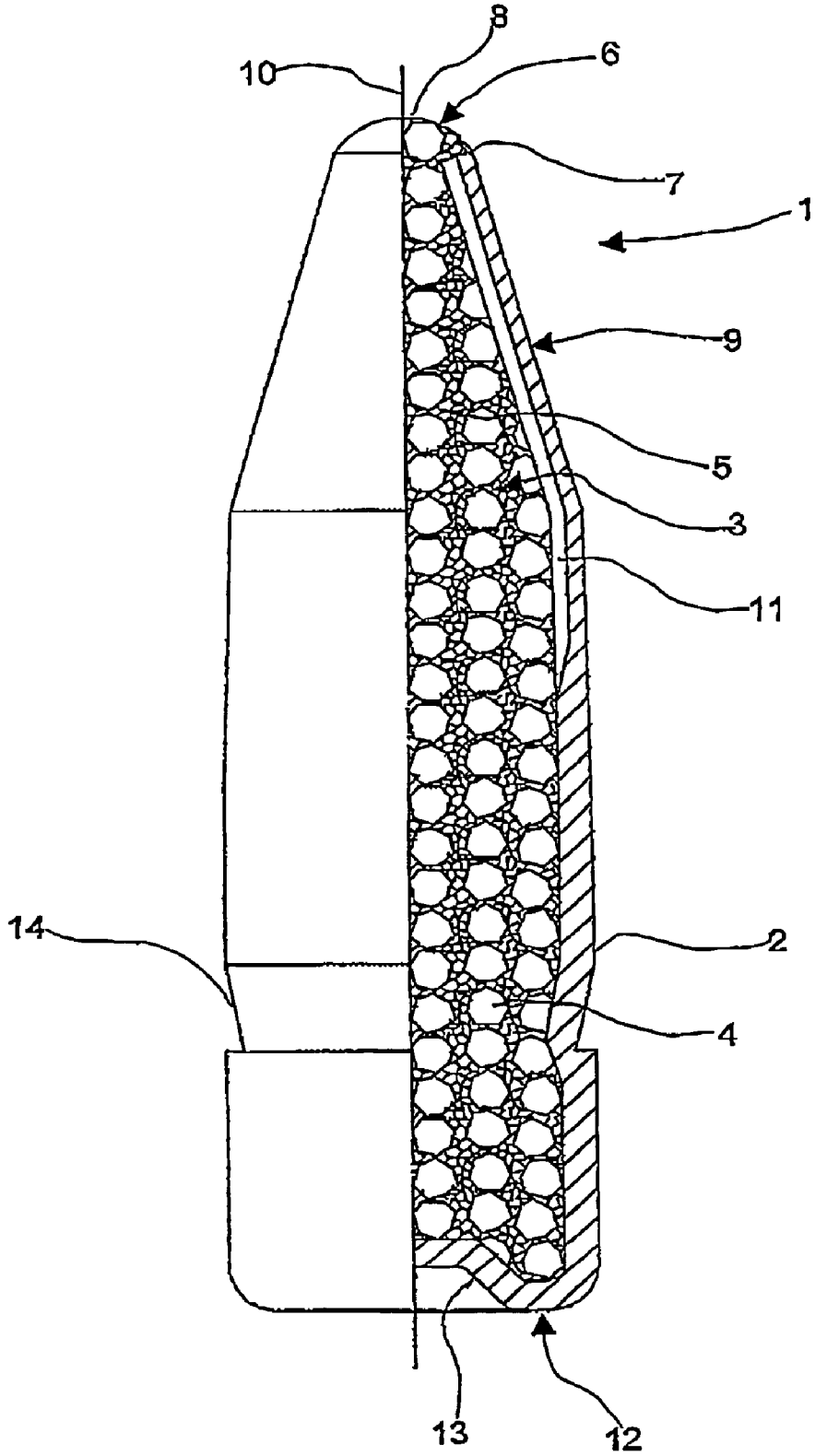
FIG. 1 shows a soft-nosed projectile depicted half in section.

A soft-nosed projectile 1 is depicted in FIG. 1. The core material was charged into initially undeformed, open projectile jacket 2 and then compacted in void-free fashion into core 3. In the present exemplary embodiment the core material is made up of large balls 4 and small balls 5. Next, projectile jacket 1 was drawn into the projectile shape depicted. In this process a compact projectile core 3 with predetermined fracture zones between the compacted balls came about. Projectile jacket 2 is not closed at projectile nose 6. Projectile core 3 protrudes from opening 7 of jacket 2 and forms projectile tip 8. On the inside of jacket 2 in ogival region 9, predetermined fracture zones in the form of grooves 11 molded into jacket 2 run in the direction of axis 10 of projectile 1. There is a cup 13 in tail 12 of projectile 1 to stabilize projectile motion and thus enhance precision. In the cylindrical region of projectile 1 there is situated a so-called sharp edge 14, a sharp-edged notch located on the outer periphery of jacket 2, which on the one hand brings about a clean entry into the skin of the game animal and on the other hand forms a further predetermined fracture zone upon the disintegration of jacket 2.

Figure 2:
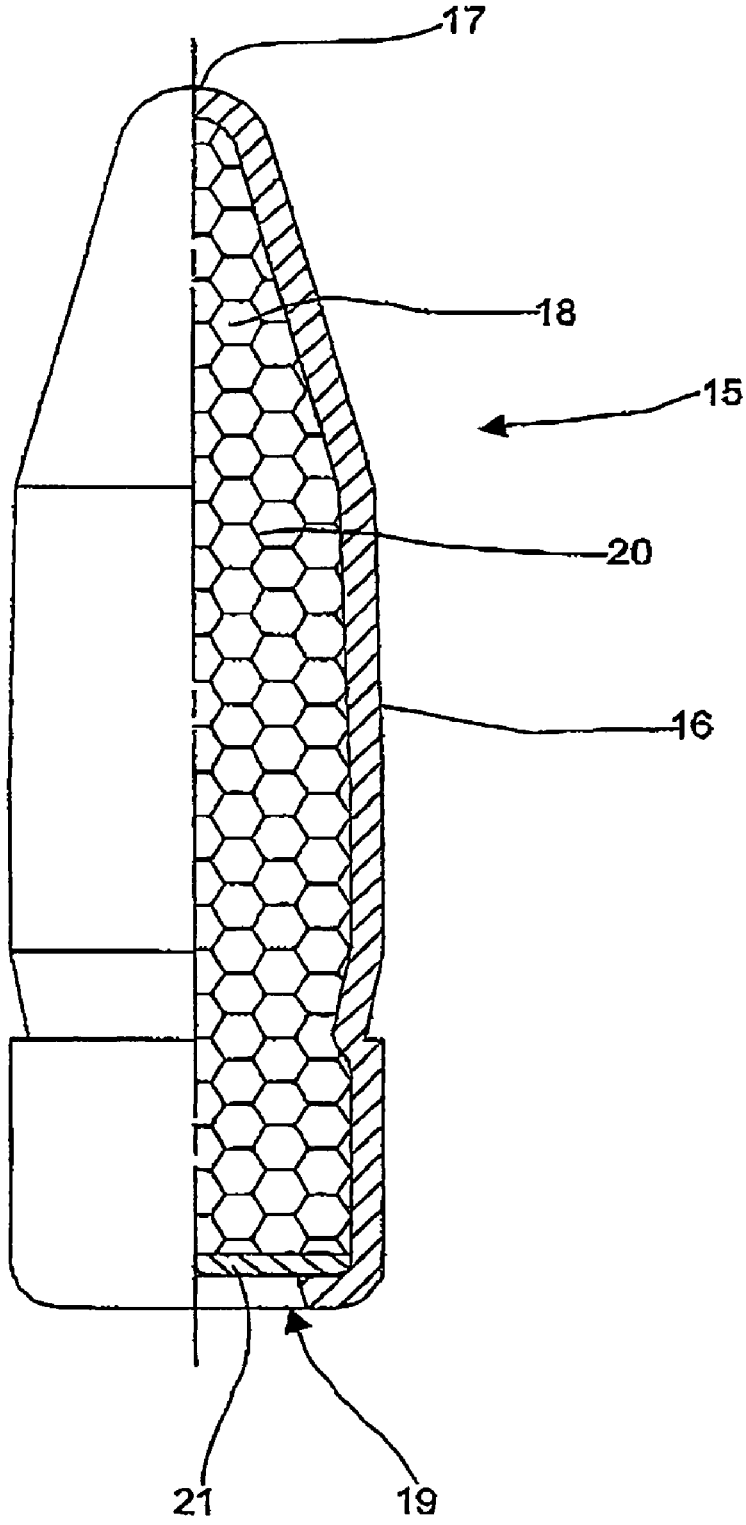
FIG. 2 shows a full-jacketed projectile, likewise depicted half in section.

A full-jacketed projectile 15 is depicted in FIG. 2. Projectile jacket 16 is closed at projectile tip 17. The core material is made up of granulate 18, which was initially charged through open tail 19 and then compacted in void-free fashion into a compact core 20. Next, tail region 19 of projectile 15 was provided with a cover 21 and the latter was crimped. Here again, a compact projectile core 20 with predetermined fracture zones between the granulate particles came about. Reference character 14 identifies a notch in the cylindrical part of projectile jacket 16, as is described in the exemplary embodiment of FIG. 1.

Figure 3:
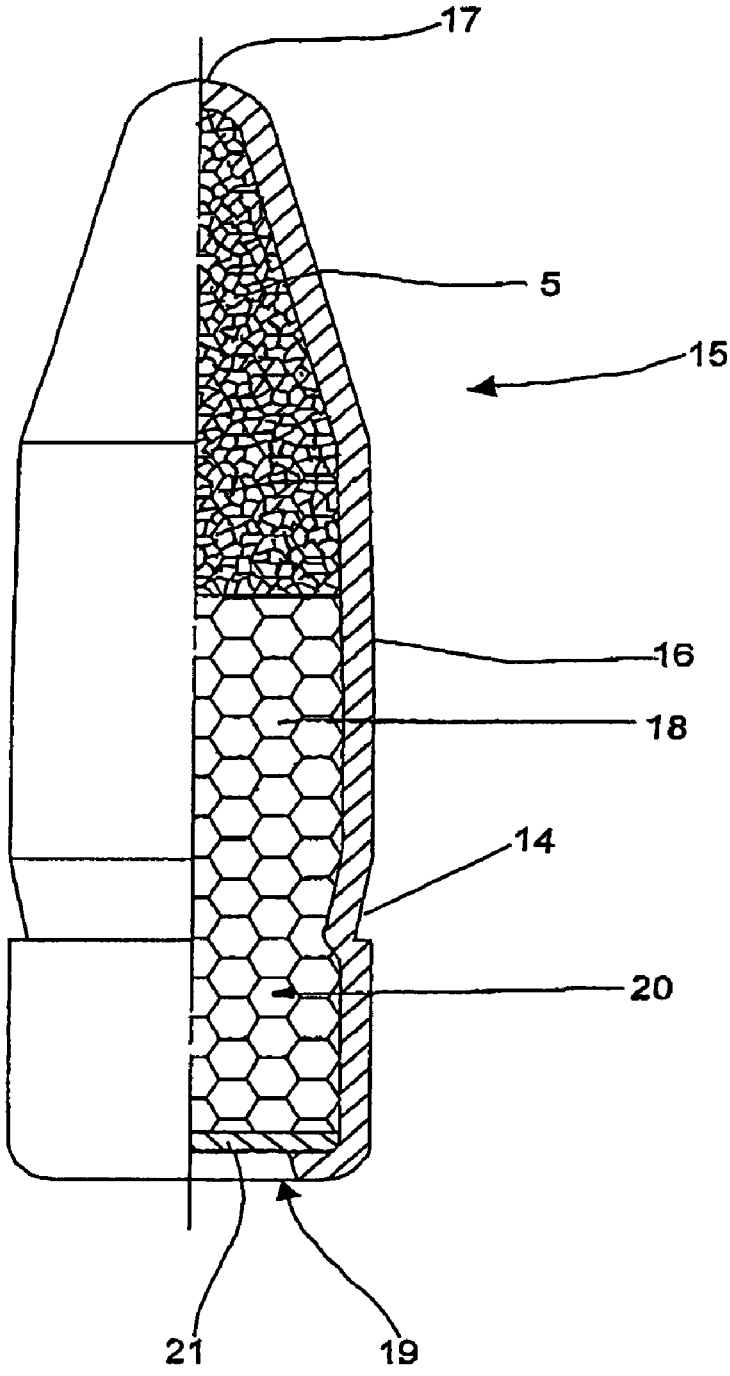
FIG. 3 shows a full-jacketed projectile depicted in half section in which the front region consists of balls or granule particles of smaller size than the cylindrical part.

As shown in FIG. 3, the bullet core may also be composed in such a way that the front region, for example the ogival region, consists of balls or granule particles 5 of smaller size than the granulate 18 of the core 20 of the cylindrical part. As a result, the core already disintegrates into many small fragments upon impact. Press molding of the two regions cannot be undertaken jointly. Each region has to be press-molded individually. The balls or granule particles of varying size may also consist of varying materials, in which case, however, the optimal position of the center of gravity with regard to the ballistics has to be guaranteed.

Figure 4:
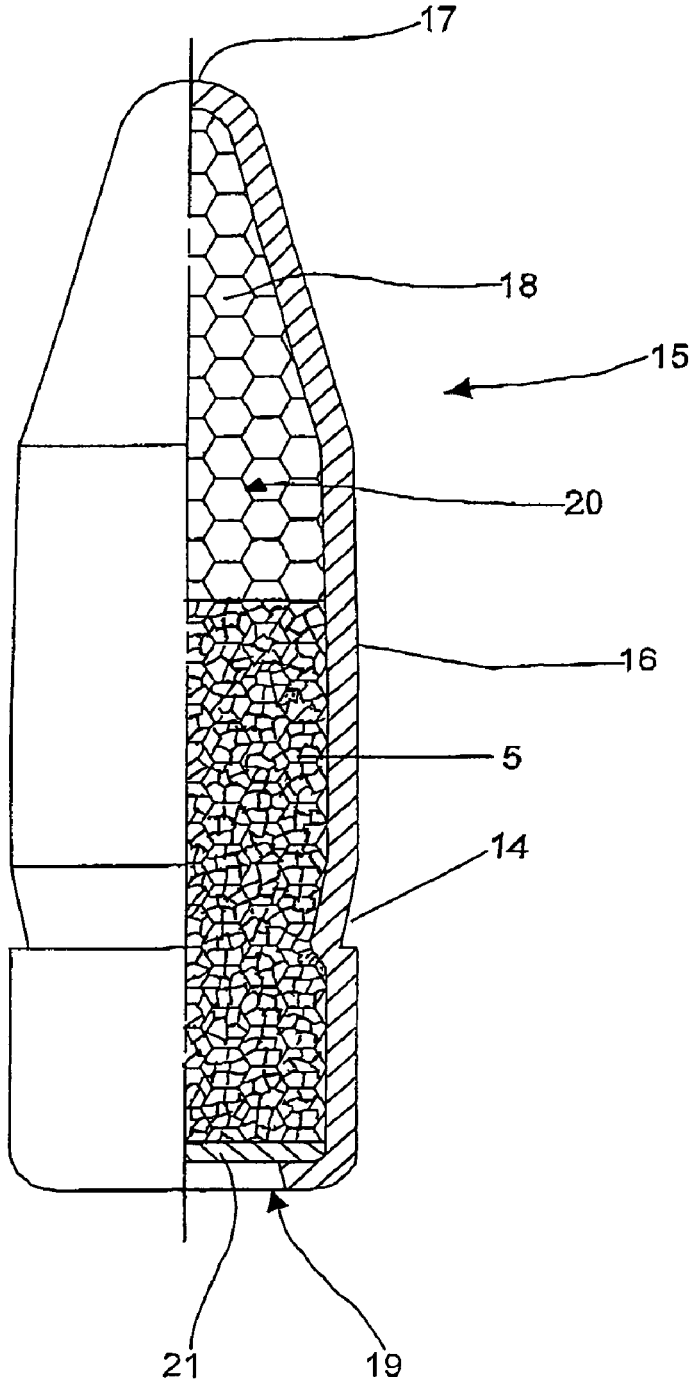
FIG. 4 shows a full-jacketed projectile depicted in half section in which the ogival region consists of balls or granule particles of greater size than the cylindrical part.

FIG. 4 shows a bullet core composed in such a way that the ogival region consists of balls or granule particles 18 of greater size than the balls or granule particles 5 of the cylindrical part.

Figure 5:
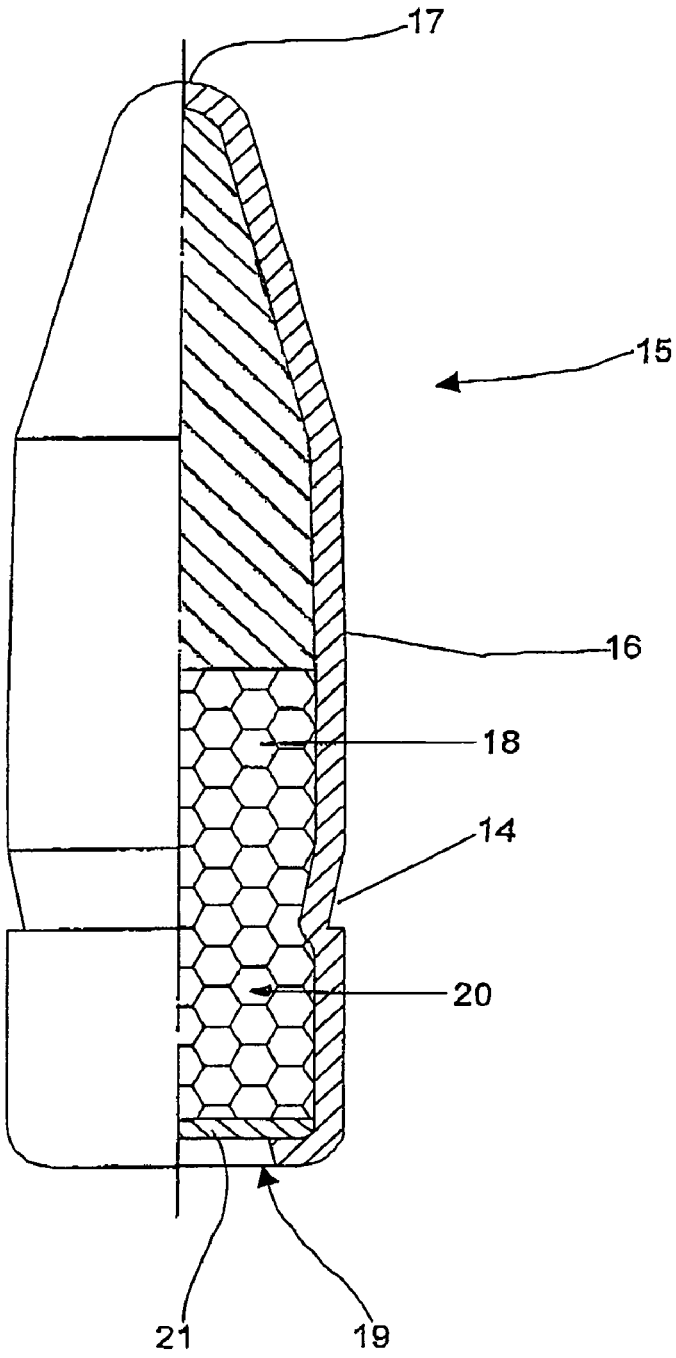
FIG. 5 shows a full-jacketed projectile depicted in half section in which a non-disintegrating penetrator is provided in the nose of the bullet.
Figure 6:
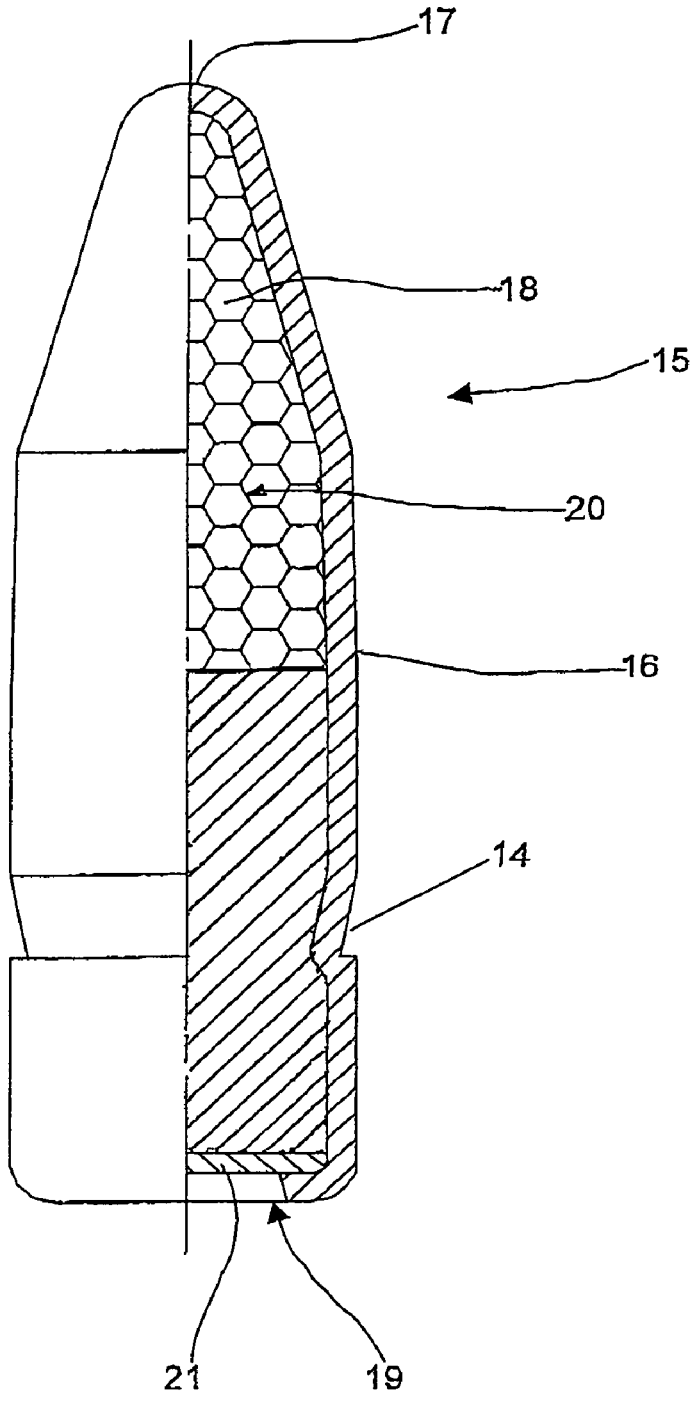
FIG. 6 shows a full-jacketed projectile depicted in half section in which a non-disintegrating penetrator is provided in the tail of the bullet.

The structure of the bullet core that has been described is suitable for all types of bullet that are capable of disintegrating partially or completely. These also include bullets with a partially hard core, with a core made of varying materials, and bullets with an additional non-disintegrating penetrator in the nose of the bullet (FIG. 5) or in the tail of the bullet (FIG. 6) such as are known from WO 01/20244 A1 or from WO 01/20245 A1, for example.

The invention claimed is:

1. A disintegrating hunting projectile as a jacketed projectile, characterized in that the projectile comprises a disintegrating core made up exclusively of balls or granulate of a metallic material, the balls or granulate having a size of 1 mm to 12 mm, and wherein the balls or the granulate are compacted in a substantially void-free fashion.

2. Hunting projectile according to claim 1, characterized in that the projectile is a soft-nosed projectile and in that the projectile core forms the projectile tip.

3. Hunting projectile according to claim 1, characterized in that the projectile is a full-jacketed projectile.

4. Hunting projectile according to claim 1, characterized in that the projectile core is composed of balls or granulate particles varying in size.

5. Hunting projectile according to claim 4, characterized in that one region of the projectile core is composed of granulate or balls of a different size from the other region and in that both regions are separately compacted.

6. Hunting projectile according to claim 5, characterized in that the regions are made up of granulate or balls of different materials.

7. Hunting projectile according to claim 1, characterized in that the balls or granulate particles are coated with a release substance.

8. Hunting projectile according to claim 7, characterized in that the release substance is graphite or polytetrafluoroethylene.

9. Hunting projectile according to claim 1, characterized in that the projectile cores are inserted into the jackets as prefabricated items.

10. Hunting projectile according to claim 1, characterized in that the projectile jacket has predetermined fracture zones.

11. Hunting projectile according to claim 10, characterized in that the predetermined fracture zones run in the direction of the projectile axis.

12. Hunting projectile according to claim 1, characterized in that the material of the projectile jacket is copper, its alloys, clad steel, soft iron, or zinc-tin alloys.

13. Hunting projectile according to claim 1, characterized in that the projectile has a cup in the tail region.

14. Hunting projectile according to claim 1, characterized in that the projectile has a sharp edge on its outer periphery.

15. Hunting projectile according to claim 1, characterized in that the projectile comprises two sub-cores and a nondisintegrating sub-core is arranged in the projectile nose and a disintegrating sub-core is arranged in the projectile tail, the disintegrating sub-core being made up exclusively of balls or granulate of a metallic material and wherein the balls or granulate are compacted in the substantially void-free fashion.

16. Hunting projectile according to claim 1, characterized in that the projectile comprising two sub-cores and a disintegrating sub-core is arranged in the projectile nose and a non-disintegrating sub-core is arranged in the projectile tail, the disintegrating sub-core being made up exclusively of balls or granulate of a metallic material and wherein the balls or granulate are compacted in the substantially void-free fashion.

17. Hunting projectile according to claim 1, characterized in that the size of the balls or granulate lies between 3 mm and 6 mm.

18. Hunting projectile according to claim 1, characterized in that the projectile core consists of the disintegrating core.

19. Hunting projectile according to claim 1, characterized in that the balls or the granulate are charged into a jacket and compacted in the substantially void-free fashion to form the disintegrating core.

20. Hunting projectile according to claim 1, characterized in that the balls or the granulate have a size chosen to cause the hunting projectile to disintegrate in a fashion attuned to game being hunted.

* * * * *